United States Patent [19]

Kampf et al.

[11] Patent Number: 4,497,455

[45] Date of Patent: Feb. 5, 1985

[54] WINDING MACHINE

[75] Inventors: Eberhard Kampf; Armin Hutzenlaub, both of Wiehl, Fed. Rep. of Germany

[73] Assignee: Erwin Kampf GmbH & Co Maschinenfabrik, Fed. Rep. of Germany

[21] Appl. No.: 487,868

[22] Filed: Apr. 22, 1983

[30] Foreign Application Priority Data

Apr. 23, 1982 [DE] Fed. Rep. of Germany ..... 3215204

[51] Int. Cl.[3] ..... B65H 35/02; H02K 49/04

[52] U.S. Cl. ..... 242/56.9; 242/65; 310/105

[58] Field of Search ..... 242/56.9, 65, 56.2, 242/75.1, 66; 310/105, 103, 96, 95, 90, 108

[56] References Cited

U.S. PATENT DOCUMENTS

| | | | |
|---|---|---|---|
| 2,984,427 | 5/1961 | Rockstrom | 242/65 |
| 3,202,374 | 8/1965 | Phelps | 242/65 |
| 3,350,026 | 10/1967 | Amos | 242/56.9 |
| 3,712,554 | 1/1973 | Lorenzini | 242/56.2 |
| 3,915,404 | 10/1975 | Kampf et al. | 242/65 X |
| 3,931,940 | 1/1976 | Raughn | 242/66 X |
| 3,934,833 | 1/1976 | Nash et al. | 242/56.9 |
| 3,949,948 | 4/1976 | Tomma | 242/56.2 |
| 4,445,058 | 4/1984 | Janson | 310/103 |

FOREIGN PATENT DOCUMENTS

| | | | |
|---|---|---|---|
| 9661 | 1/1982 | Japan | 242/56.9 |
| 712559 | 1/1980 | U.S.S.R. | 310/103 |

*Primary Examiner*—Stuart S. Levy
*Assistant Examiner*—Leo J. Peters
*Attorney, Agent, or Firm*—Bacon & Thomas

[57] ABSTRACT

A winding machine for longitudinal slit strips, with slides which carry pendulum arms with receivers for winding cores and are movable, on a guide, transversely to the longitudinal slit direction, a driving drum being positioned beneath the guide, which driving shaft is frictionally connectable, with a driving wheel of each slide, and each driving wheel driving the winding core receiver of the specific pendulum arm. The technical problem is in the facility and shortening of the re-tooling to other slitting widths as well as in the adjustment of the winding tension. The driving shaft comprises a continuous peripheral surface. Each driving wheel is provided as a friction wheel which is brought into frictional engagement with the driving shaft. Each driving wheel is coupled via a clutch, preferably an eddy-current clutch with adjustable clutch disk, to a driving shaft.

4 Claims, 2 Drawing Figures

WINDING MACHINE

BACKGROUND OF THE INVENTION

1. Field of the Invention

The invention relates to a winding machine for longitudinal slit strips, with slides which carry pendulum arms with receivers for winding cores and are movable, on a guide, transversely to the longitudinal slitting direction, a driving drum being positioned beneath the guide, which driving shaft is frictionally connectable, with a driving wheel of each slide, and each driving wheel driving the winding core receiver of the specific pendulum arm.

2. Description of the Prior Art

A prior art winding machine of the said type is provided with gear wheels for the power transmission between the driving drum and the driving wheels. This arrangement is extremely impeding for a stepless adjustment of the slitting width, because it is necessary in each case to newly adjust not only the slides but also the gear wheels. Furthermore, a displacement of the slides particularly moving out the slides from the working width into a parking station is difficult, because the gear wheels impede this displacement. Moreover, the gear wheels cause considerable noise. Finally, adjustment of the winding tension presents difficulties in the case of such prior art arrangement.

SUMMARY OF THE INVENTION

It is the object of the present invention to facilitate and to shorten the re-tooling of the winding machine to other slitting widths and to adapt the winding tension.

According to the present invention this object is solved by the following features:

(a) the driving drum comprises a continuous peripheral surface;

(b) each driving wheel is provided as a friction wheel which is brought into frictional engagement with the driving drum;

(c) each driving wheel is coupled via a clutch preferably an eddy-current clutch with adjustable clutch disk to a driving shaft.

The present invention differs from the prior art in a non-obvious manner in that the driving wheel of a slide is connectable with the driving drum in any position, due to the fact that it acts upon the continuous peripheral surface. Consequently, the user is completely free with regard to the adjustment of the winding width. In particular no adjustment work is necessary in order to render possible the power transmission from the driving drum to the driving wheel. Each slide may be moved to the desired position. It is sufficient to clamp the slide within the guide. By this facility the re-tooling time of the machine is considerably reduced. Furthermore, it does not present any difficulties to move out a slide from the working width of the machine into a parking station. The driving wheel provided as a frictional wheel is covered on the periphery with a polymer coating (e.g. polyurethane), and this secures nonskid power transmission. The eddy-current clutch allows an adjustment of the winding tension and compensates possible eccentricities of the frictional wheel. Consequently, the frictional wheel can be adjusted without any difficulties. In addition, by the adjustment of the clutch gap it is possible to adjust the torque to be transmitted and, thus, the winding tension.

In order to adjust the contact pressure of the frictional wheel and/or to compensate a wear of the frictional wheel, the invention provides that each slide comprises a hollow journal with an inner eccentric ring and an outer eccentric ring rotatable thereon, upon which the specific driving wheel is supported.

Furthermore, the invention provides that the outer eccentric ring is adjustable by means of an adjusting cylinder acting upon an adjusting rod. Thereby in each case an automatic pressing on of the frictional wheel during the winding operation as well as an adjustment of the contact pressure is possible. In addition, the frictional wheel may be lifted from the driving shaft.

Moreover, the invention provides that the slide guide is designed as a ball guide. Thereby the displacing of the slides is easier, particularly any canting in a profiled rail is excluded.

In order to adjust the clutch gap of the eddy-current clutch and thus to adjust the torque to be transmitted provision is made that the clutch disk is axially movable on the driving shaft, and that for the axial displacement an adjusting member is coupled with the clutch disk. Thereby the winding torque of each individual winding station can be adjusted with regard to the neighbouring stations having possibly other slitting widths. The entire winding tension is adjusted via the speed of the driving drum in relation to the increase of the roll diameter.

Ultimately, the invention proposes that the adjusting member comprises a hollow spindle which is rotatably connected with the clutch disk, but undisplaceable in axial direction.

BRIEF DESCRIPTION OF THE DRAWINGS

One embodiment of the invention will be described in the following with reference to the attached drawings, wherein.

DESCRIPTION OF THE PREFERRED EMBODIMENT

Figure 1:
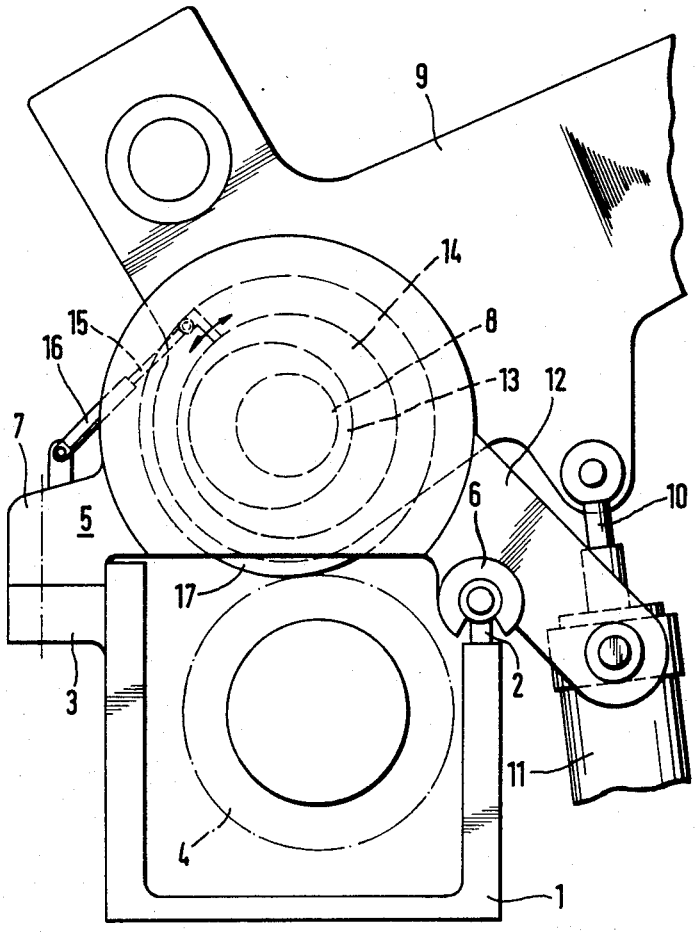
FIG. 1 is a side view of a winding station with broken-off pendulum arm, whilst
Figure 2:
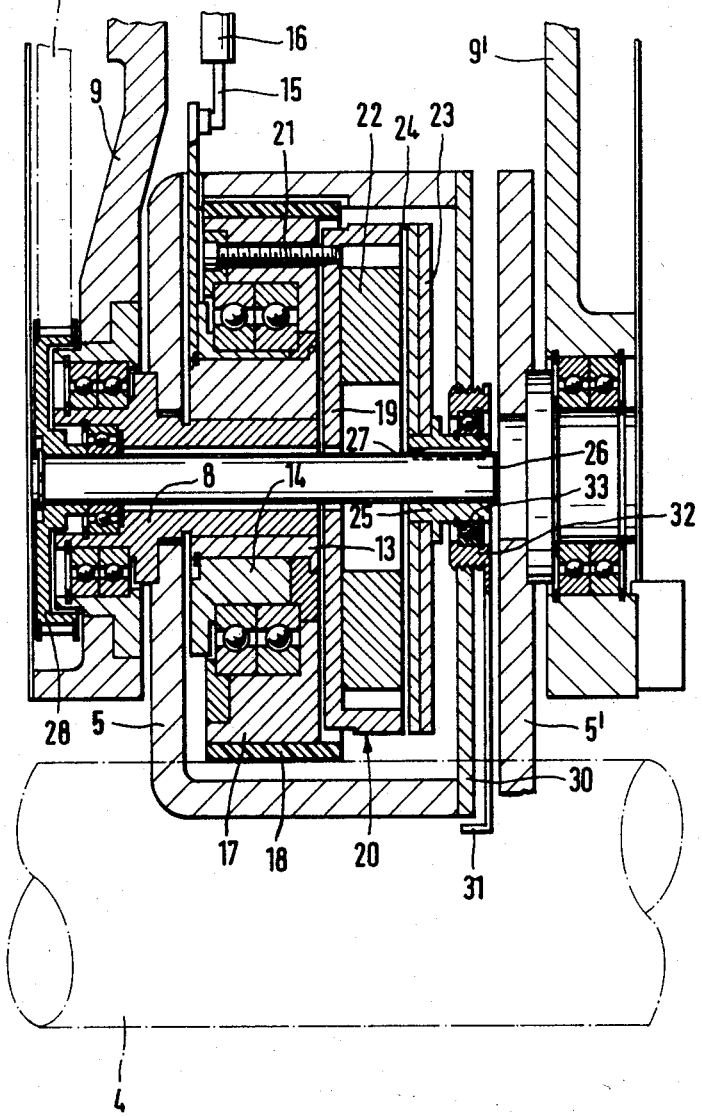
FIG. 2 is a turned-about sectional view.

A longitudinal slitting machine, not shown as a whole, comprises a plurality of winding stations arranged transversely to the longitudinal slitting direction, which winding stations are positioned on a rail 1, extending transversely over the entire width of the machine. The rail 1 has a guide 2 and a tensioning arm 3. A driving drum 4 with a continuous peripheral area, in parallel with rail 1, is provided in which the drum extends also over the entire width of the winding machine and is driven by a drive mechanism not shown.

The figures show a slide 5 which extends over the rail 1 and which is guided by a ball guide 6 on the guide 2. A clamping lug 7 of the slide 5 may be clamped, in any position, with the tensioning arm 3 of the rail 1 so that thereby the slide can be arrested. Within the slide 5, or a bearing plate of the slide 5, respectively, a hollow journal 8 is supported, upon which a pendulum arm 9 is swivel-mounted. The pendulum arm 9 is hinged on a piston rod 10 of an adjusting cylinder 11, which is held on an arm 12 of the slide 5. The adjusting cylinder 11 allows a swivelling of the pendulum arms in relation to the increase of the roll diameter. The slide 5 contains the drive mechanism for the receiving claw at the end of the pendulum arm 9, which is not shown. A further slide 5' is situated opposite the slide 5, the slide 5' also carrying a pendulum arm 9', but not containing a drive mechanism, because only the receiving claw at one end of the specific winding core being driven. This slide 5', with the exception of the drive mechanism, is constructed simularly as the slide 5. For large material widths and winding tensions this pendulum arm 9' may also be provided as a driven pendulum arm.

On the hollow journal 8 an inner eccentric ring 13 is situated, over which an outer eccentric ring 14 engages. The outer eccentric ring 14 is coupled with the adjusting rod 15 of an adjusting cylinder 16 so that the outer eccentric ring 14 is swingable to both directions in a manner as evident from FIG. 1. A frictional wheel 17 with a frictional coating 18 is supported on the outer eccentric ring 14. In the normal position according to FIG. 1 the frictional wheel 17 abuts upon the driving drum 4. A swivelling of the outer eccentric ring 14 in clockwise direction effects an increase of the contact pressure of the frictional wheel so that thereby the contact pressure and the torque to be transmitted may be adjusted. In addition, abrasion and wear can be compensated in this manner. Any swivelling of the outer eccentric ring anticlockwise causes a lifting of the frictional wheel 17 from the driving drum 4 so that thereby the displacing of the slide 5 in axial direction of the driving drum 4 is made easier.

With the frictional wheel 17 the housing 19 of an eddy-current clutch 20 is firmly connected, e.g. by means of tightening screws 21. The eddy-current clutch 20 contains permanent magnets 22 in the usual manner. A clutch disk 23 is situated opposite the housing 19, a gap 24 being left open. The gap width determines the torque to be transmitted.

A sleeve 25 is firmly connected with the clutch disk 23 and engages, by means of a coupling key 27, into a driving shaft 26 so the the sleeve 25 is displaceable on the shaft 26 in axial direction. The driving shaft 26 extends through the hollow journal 8 and carries on the opposite end a pulley 28 which drives a belt 29. The belt 29 drives the receiver, not shown, for the winding core.

A plate 30 is fastened on the housing of the slide 5 and has, within a central passage, surrounding the driving shaft 26, an internal thread. An external thread of the hollow 32, which comprises an adjusting lever 31, which projects beyond the outer periphery of the plate 30, engages into this internal thread. The hollow spindle 32 is connected, by means of an axial thrust bearing 33 or by a similar connection, with the sleeve 25 so that the sleeve 25 is freely rotatable within the hollow spindle 32, however, is taken along or caught in case of axial displacements of the hollow spindle 32. By means of the adjusting lever 31 an axial adjustment of the hollow spindle 32 and, thus, an adjustment of the clutch disk 23 via the sleeve 25 is possible. Thereby it is possible to adjust the gap 24 and the torque to be transmitted of the eddy-current clutch. This adjustment is also possible during the winding-up operation.

A single winding station is shown in the figures. Of course, a plurality of winding stations ar arranged over the entire working width of the machine, which winding stations are all displaceable on the common rail 1 and adjustable thereon and which are driven by the common driving drum 4. The speed of the driving drum 4 is adjusted in accordance with the desired winding tension for all stations together. The torque and/or the winding tension, respectively, of each individual winding can be adjusted by means of the adjusting lever 31.

The ball guide 6 allows an easy displacement of the slide, without occurrence of an obstruction caused by canting, or the like.

The frictional wheel 17 can be pressed against the driving drum 4 by the aid of the adjusting cylinder 16. By this measure an alteration of the torque to be transmitted is possible. In case of wear of the friction coating 18 due to abrasion, readjustment of the frictional wheel is possible without difficulty. The eccentricity occuring thereby is compensated by the eddy-current clutch 20 without difficulty. On the other hand, the frictional wheel can be lifted from the driving shaft so that damages are excluded when adjusting or re-tooling the machine.

Each slide can be moved over the entire working width of the machine and, consequently, can also be moved out from the working width into a parking station, if any slide is not required. The slide can be clamped tightly on the guide in any position desired. Thereby a stepless adjustment of the slitting width is possible.

We claim:

1. A winding machine for winding a longitudinally slit strip, said winding machine having a number of winding stations; each winding station comprising: a driving shaft; a frictional wheel; an eddy-current clutch which couples the frictional wheel to the driving shaft; wherein the clutch includes a clutch housing and a clutch disk which are adjustably spaced so that the torque transmitted between the clutch housing and the clutch disk may be varied; wherein the clutch disk is axially movable on the driving shaft, and further comprising an adjusting member coupled with the clutch disk to allow for axial displacement of the clutch disk; whereby the winding tension of each winding station is independently and relatively adjustable.

2. A winding machine according to claim 1, wherein the adjusting member comprises a hollow spindle connected with the clutch disk to be relatively rotatable with respect to the clutch disk, and relatively fixed in the axial direction with respect to the clutch disk.

3. A winding machine according to claim 1, further comprising at least one slide having a hollow journal, an inner eccentric ring positioned on the external portion of the journal, an outer eccentric ring positioned on the external portion of the internal ring and rotatable thereon, so that the frictionaly wheel is supported by the outer eccentric ring, wherein the adjusting member comprises a hollow spindle connected with the clutch disk to be relatively rotatable with respect to the clutch disk and relatively fixed in the axial direction with respect to the clutch disk.

4. A winding machine according to claim 1, further comprising at least one slide having a hollow journal, an inner eccentric ring positioned on the external portion of the journal, an outer eccentric ring positioned on the external portion of the internal ring and rotatable thereon, so that the frictional wheel is supported by the outer eccentric ring, wherein the outer eccentric ring is rotatably adjustable relative to the inner eccentric ring by means of an adjusting cylinder acting upon an adjusting rod, wherein the adjusting member comprises a hollow spindle connected with the clutch disk to be relatively rotatable with resepct to the clutch disk, and relatively fixed in the axial direction with respect to the clutch disk.

* * * * *